US007216518B2

(12) United States Patent
Shao

(10) Patent No.: US 7,216,518 B2
(45) Date of Patent: May 15, 2007

(54) MECHANICAL DIAL COMBINATION LOCK

(76) Inventor: Zhijun Shao, c/o Ms. Jianwen Cui Huerjian High School, Yijing District, Taiyuan City, Shanxi Province (CN) 030021

( * ) Notice: Subject to any disclaimer, the term of this patent is extended or adjusted under 35 U.S.C. 154(b) by 0 days.

(21) Appl. No.: 11/146,317

(22) Filed: May 26, 2005

(65) Prior Publication Data

US 2005/0217326 A1 Oct. 6, 2005

Related U.S. Application Data

(63) Continuation of application No. PCT/CN03/00946, filed on Nov. 10, 2003.

(30) Foreign Application Priority Data

Dec. 2, 2002 (CN) ..... 02 1 35963

(51) Int. Cl.
*E05B 37/08* (2006.01)

(52) U.S. Cl. ..... 70/303 A; 70/DIG. 9

(58) Field of Classification Search ..... 70/301, 70/302, 303 R, 303 A, DIG. 9
See application file for complete search history.

(56) References Cited

U.S. PATENT DOCUMENTS 2,792,703 A * 5/1957 Murray ..... 70/314
2,797,271 A * 6/1957 Augustine ..... 200/42.01
3,878,346 A * 4/1975 Green ..... 200/42.01
4,476,698 A * 10/1984 Treslo ..... 70/25
4,574,603 A * 3/1986 Parma ..... 70/303 A
4,722,207 A * 2/1988 Wertz, Jr. ..... 70/303 A
4,726,204 A * 2/1988 Peyronnet ..... 70/315
4,776,190 A * 10/1988 Miller et al. ..... 70/303 A
4,841,759 A * 6/1989 Balasingam ..... 70/302
4,961,332 A * 10/1990 Deswarte et al. ..... 70/303 A
5,343,723 A * 9/1994 Miller et al. ..... 70/303 A
5,575,164 A * 11/1996 Ohsawa ..... 70/303 A
6,378,344 B1 4/2002 Gartner ..... 70/278.1

FOREIGN PATENT DOCUMENTS

CN 1238418 12/1999
CN 2389213 7/2000
CN 2460677 11/2001

* cited by examiner

*Primary Examiner*—Lloyd A. Gall
(74) *Attorney, Agent, or Firm*—Vidal A. Oaxaca; Jeffrey D. Myers; Peacock Myers, P.C.

(57) ABSTRACT

A mechanical dial combination lock for use in safes, file cabinets, security doors, vaults and warehouse doors. The disk type mechanical combination lock features a plurality of annular code discs, a base disc, a latch, an unlatching mechanism, a positioning mechanism, a dialing mechanism, a repositioning mechanism, a code-detecting mechanism, a casing and a dial. The dial combination lock is easily operated by persons familiar with conventional dial-face type combination locks, and yet is may be operated faster, and permits the combination code to be easily changed to any of a greater number of possible code combinations.

5 Claims, 10 Drawing Sheets

MECHANICAL DIAL COMBINATION LOCK

FIELD OF THE INVENTION

The present invention relates in general to a disk type mechanical combination lock wherein a combination code is inputted through rotation, more particularly, to a mechanical dial combination lock.

BACKGROUND OF THE INVENTION

At present, various conventional disk type mechanical combination locks are widely used in safes, file cabinets, security doors, vaults and warehouse doors.

FIGS. 1, 1A, 1B, 1C and 1D show a conventional disk type mechanical combination lock. As shown in FIG. 1A, a conventional disk type mechanical combination lock typically comprises 3–4 discs having a notch. The disc 1 is connected to a dial 5-0 outside the door by a spindle 5-1 and rotates synchronously with the dial 5-0. The discs 2 and 3 are fitted over a fixed sleeve (not shown) which is coaxial with the spindle 5-1. The discs 2 and 3 may either rotate or are immovable on the sleeve.

As shown in FIG. 1B, a control piece 6 is moved downwards and enters into the notches when all the notches 1-4, 2-4 and 3-4 of the discs 1, 2 and 3 are in alignment with the control piece 6. Restriction applied by the control piece 6 to the unlatching (unlocking) mechanism is released by the downward movement of the control piece 6, thus the latch will be released by the unlatching mechanism. However, even if only one notch is not in alignment with the control piece 6, the latch will not be released because the control piece 6 is prevented from moving downwards.

The process of inputting combination code is to align the notches of the discs with the control piece 6 by rotating the discs. The operation of inputting combination code is described as follows. As shown in FIG. 1C, the dial 5-0 outside the door is rotated in one direction (assuming in a counterclockwise direction) for at least three revolutions, then the disc 1 is certainly rotated synchronously. The disc 1 is dialed to rotate along with the dial 5-0 when a protrusive tongue 1-3 of the disc 1 is brought into contact with a protrusive tongue 2-3 of the disc 2, and the disc 2 is also dialed to rotate along with the dial 5-0 when the other end of the protrusive tongue 2-3 is brought into contact with a protrusive tongue 3-3 of the disc 3. The counterclockwise rotation of the dial 5-0 is stopped when the notch 3-4 of the disc 3 is in alignment with the control piece 6, the code on the scale plate of the dial 5-0 which is in alignment with a reference line is determined as the first combination code. As a result, the operation of inputting of the first combination code is completed.

As shown in FIG. 1D, when the dial 5-0 is rotated in the reverse direction (that is, in a clockwise direction) for almost one revolution, the protrusive tongue 1-3 of the disc 1 is brought into contact with the protrusive tongue 2-3 of the disc 2 from the other direction, and then the disc 2 is dialed to rotate along with the dial 5-0 synchronously in the clockwise direction. The clockwise rotation of the dial 5-0 is stopped when the notch 2-4 of the disc 2 is in alignment with the control piece 6, the code on the scale plate of the dial 5-0 which is in alignment with the reference line is determined as the second combination code. The operation of inputting of the second combination code is thus completed. Finally, the dial 5-0 is rotated in the counterclockwise direction for less than one revolution to ensure that the protrusive tongues 1-3 and 2-3 will not collide with each other, then the notch 1-4 of the disc 1 is also in alignment with the control piece 6. The whole process for inputting the combination code is thus finished. It should also be noted that whether protrusive tongues of discs are in alignment with the control piece 6 or not can not be acknowledged by a person outside the door, thus the above process is definitely under control of the scale on the edge of the dial 5-0 and a predetermined combination code. The position of the protrusive tongue 1-3 at the circumference of the disc 1 may be changed to alter the combination code, but only a few sets of combination code may be created.

As described above, the operation process for this kind of combination lock is very complicated. The operation will be even more complicated if the lock employs more discs. In order to reduce the number of the discs while increasing the number of the combination codes, the scale at the edge of the dial should be made very fine, which in turn requires a careful operation.

The conventional disk type mechanical combination lock described above has the following disadvantages:

1. The conventional disk type mechanical combination lock requires complicated operations. Since the outer dial is only connected to one driving disc at the inner side of the lock, thus other inner driven discs are not directly rotated by the dial, but indirectly driven through the collision between the respective protrusive tongues of the driving and driven discs. Therefore, in order to rotate these discs to a predetermined position, the dial is required to be rotated repeatedly in a forward direction and then in a reverse direction. For a conventional disk type mechanical combination lock with three discs, the forward and reverse rotation should be repeated for almost ten revolutions in order that a right combination code is dialed. If an advanced disk type mechanical combination lock in which dialing and unlocking is performed through the same dial is used, such as the those produced by Sargent & Greenleaf and LA GARD companies, the operation will be more complicated because an additional disc is introduced.

2. It is not easy to input the combination code in the conventional disk type mechanical combination lock. Because the combination code is recognized based on the fine scale at the edge of the dial and identified by use of a fine rotation angle, it has a great risk that the code is wrongly inputted due to a careless operation.

3. The conventional disk type mechanical combination lock has small quantity of combination codes. Taking a three-disc mechanical combination lock as an example, if the dial has 100 scale values, the lock will have $100^3$=1 million sets of combination codes in theory. However, such a number of codes can not be actually achieved at all. This is because it is very difficult to distinguish one scale value (3.6 degrees) by manual operation when the code is inputted by the dial. In addition, it is impossible to match the combination code according to one scale value due to machining errors generated in the manufacturing process. Adequate allowance have to be set in advance for the lock when it is manufactured so as to ensure that the combination code can be inputted successfully. Accordingly, the conventional disk type mechanical combination lock allows for ±1.5 difference in scale value, that is, every three scale values form one effective scale value. The finest scale at the edge of the dial will have 100 scale values, which forms 50 effective scale values. Therefore, a three-disc mechanical combination lock actually only have $50^3$=125 thousand sets of combination codes, which is far less than the nominal code amount. The operation will become extremely complicated if a four-disc combination lock is adopted for purpose of increasing code amount.

SUMMARY OF THE INVENTION

In view of the above disadvantages of the conventional disk type mechanical combination lock, an object of the present invention is to provide a disk type mechanical combination lock which is operable in a simple and fast manner. Most people are familiar with the general operation of disk type mechanical combination locks according to the present invention. Further, the disk type mechanical combination lock according to the present invention has a large quantity of codes. Its combination code is also capable of being altered by authorized users.

A key point for achieving the above object is to completely change the manner by which the discs are rotated. In the traditional manner, a driven disc is set into a designated position through several revolutions of rotation in forward and reverse directions of the driving disc. In the present invention, a dialing mechanism is driven by an outer dial and an annular code disc is rotated to a designated position by a dialing block on the dialing mechanism once the dialing mechanism is dialed (either in a clockwise direction or in a counterclockwise direction). Then the dialing mechanism returns to the initial position (original position), and the single effective position of the dialing block on the dialing mechanism is changed. Rotating the dialing mechanism once again will rotate the next annular code disc into a designated position. A plurality of annular code discs may be rotated into their designated positions in sequence by repeating the above operation.

The disk type mechanical combination lock of the present application comprises a plurality of annular code discs, a base disc, a latch, an unlatching mechanism, a positioning mechanism, a dialing mechanism, a repositioning mechanism, a code-detecting mechanism, a casing and a dial. The dialing mechanism comprises a frame, a dialing block and a controller. The frame is a cylinder in which a groove is provided for accommodating of the dialing block and a protrusive tongue is provided at an end of the cylinder, and the frame is connected to the outer dial through a coupling spindle. The dialing block has a sheet form and is fixed in the groove of the frame, with its end being capable of going in and out a sleeve. The controller comprises a sleeve, a pawl and a controlling disc. The sleeve is rotatably fitted over the cylinder of the frame and has a slot opening on the surface in the circumferential direction which the end of the dialing block goes into and out of, ratchet is provided on an end surface of the sleeve with a projecting edge being provided at the outer edge of the controlling disc. The pawl is fixed to the base disc through a rotating shaft and its front end is in contact with the outer edge of the controlling disc and the ratchet on the end surface of the sleeve. The repositioning mechanism comprises a repositioning ring, a spring and a bracket. The repositioning ring is an annular sheet and rotates around the coupling shaft spindle as an axis thought the bracket. The code-detecting mechanism comprises a controlling piece, a limit boss, a staff and a spring. The controlling piece is fixed on the base disc through the staff and its front end is in contact with the outer edge of the annular code disc.

The unique effective position of the dialing block on the dialing mechanism may be altered in sequence, then ejects singly or moves in sequence, thus rotate each annular code disc one by one. The controller controls the effective position of the dialing block to be altered in sequence, then ejects singly or moves in sequence, thus limits the repositioning.

The function and structure of the annular code disc of the present invention is the same as those of the disc in the conventional disk type mechanical combination lock. The repositioning mechanism may rotate unidirectionally along with the rotation of the dialing disc. When the rotating direction of the dialing mechanism is opposite to the dialing direction, the plurality of annular code discs return to the initial position.

When the dial is rotated in a reverse direction for a predetermined angle, the code-detecting mechanism moves towards the plurality of annular code discs. If all the plurality of annular code discs are rotated to designated positions, the unlatching mechanism is driven to hook an inner member which rotates along with the dial or other operational units, and thus moves correspondingly. Even if only one of the annular code discs is not rotated to the designated position, the unlatching mechanism will not hook the inner member or other operational units because of its limited movement. The unlatching mechanism may be driven either by the dial wherein the latch is released simultaneously with the repositioning or by a separated mechanism. A pushing feeling will be obviously felt when the dial is oriented to the initial position or a code position through the positioning mechanism.

The disk type mechanical combination lock of the present invention operates as follows:

a. The operation of the disk type mechanical combination lock starts at an initial position of the dial. When the outer dial is rotated in a forward direction from the initial position, the dialing block of the dialing mechanism is driven to rotate one annular code disc into a designated position, therefore, the first code is inputted. Then the dialing disc returns to its initial position and the single effective position of the dialing block on the dialing mechanism is changed (the dialing block moves or the other one ejects singly in sequence). Another annular code disc is rotated into a designated position by the dialing block of the dialing mechanism when the dial is rotated in the forward direction once again, thus the second code is inputted. The procedure of inputting the combination code is accomplished when all the annular code discs are rotated to their designated positions through repetition of the above operation.

b. The dial is rotated in a reverse direction from the initial position of dial, which activates an accessory inner interconnected mechanism. First, the code-detecting mechanism in the accessory inner interconnected mechanism determines whether all the annular code discs are rotated to their designated position. If so, the unlatching mechanism of the latch will hook one of the inner members which rotates along with the dial so as to make the latch be movable. Otherwise, the above-mentioned hooking operation is not performed so that the latch can not be moved. The dial is continued to be rotated in the reverse direction, and the annular code disc is returned to the initial position by the repositioning mechanism on the accessory inner interconnected mechanism. The latch is enabled to be released, and at the same time the controller in the dialing mechanism brings the dialing mechanism into its initial position. The lock is ready for the next operation after the dial returns to its initial position.

Although the present invention is an improvement to the conventional disk type mechanical combination lock, it goes beyond the conventional inventive concept. Only the structure of discs and the way by which part-rotation is performed in the prior art are retained in the present invention. The operation procedure of the combination lock of the present invention is similar to that of a dial-type telephone by means of a novel set of inner combined arrangement. Therefore, the disk type mechanical combination lock of the present invention is easy to be learned by and used for ordinary people. At the same time, only ten or a little more codes or symbols is required to be formed on the outer dial. Consequently, the distance between the scales can be enlarged. Thus, the scales are only needed to be roughly aligned during dialing operation, therefore, the dialing operation can be changed from an analogous-angle dialing mode to a digital inputting mode. The present invention may use a plurality of annular code discs by which the user may alter combination code at will and remember the code in a convenient way. The number of bits for the combination code is increased or decreased by adding or removing of some members of the lock, thus a good variety of locks satisfying different needs may be produced, in which the high-class lock has more than one million sets of combination codes, matching with the code amount of the electronic combination lock.

The disk type mechanical combination lock of the present invention may be applied in safes, file cabinets, security doors, vaults and warehouse doors and civilian doors. It may replace a conventional disk type mechanical combination lock or part of an electronic combination lock. Compared with the prior art, the present invention may be operated in a simple and fast manner, and most people are accustomed to this disk-type dialing mode. The combination lock of the present invention has a large code amount, in which the combination code may be selected by a user in a range from a minimum value of "00 . . . " to a maximum value of "XX . . . " according to a predetermined number of bits, thus facilitating keeping the combination code in mind. The disk type mechanical combination lock of the present invention needs no power supply because it employs a full mechanical structure which has a higher reliability and can endure high temperature, high humidity and vibration. If the same dial is used for the inputting of code and unlatching of the latch or a linkage mechanism, and is incorporated for the reason of having a plurality operation means, then it is almost impossible for an unauthorized intruder to unlock the combination lock in a tentative way. In addition, the present invention is readily commercially manufactured because all the parts are fabricated by ordinary machining processes.

BRIEF DESCRIPTION OF THE DRAWINGS

FIG. 1A is a schematic view showing the structure of the conventional disk type mechanical combination lock;

FIG. 1B is a schematic view showing the unlock position of the conventional disk type mechanical combination lock;

FIG. 1C is a schematic view showing the conventional disk type mechanical combination lock rotating in a counterclockwise direction; and FIG. 1D is a schematic view showing the conventional disk type mechanical combination lock rotating in a clockwise direction.

FIG. 2A is a schematic view showing the structure of the first embodiment;

FIG. 2B is a rear perspective view of the embodiment seen in FIG. 2A;

FIG. 2C is a schematic view showing the position of the dialing block in the first embodiment;

FIG. 2D is a cross section view of the discs in the first embodiment;

FIG. 2E is a schematic view showing the dialing block rotating an annular code disc in the first embodiment;

FIG. 2F is a schematic view showing a stepping movement of the dialing block in the first embodiment;

FIG. 2G is a schematic view showing the dialing block rotating the second annular code disc in the first embodiment; and FIG. 2H is a schematic view showing a second stepping movement of the dialing block in the first embodiment.

FIG. 3A is a schematic view showing the structure of the dialing mechanism in the second embodiment;

FIG. 3B is a rear perspective view of the embodiment seen in FIG. 3A;

FIG. 3C is a schematic view showing the assembling structure of the dialing block after the dialing mechanism is cut away in the second embodiment;

FIG. 3D is a schematic view showing the structure of the dialing mechanism after the sleeve is detached; and FIG. 3E is a schematic view showing the structure of the single sleeve of the dialing mechanism.

FIG. 4A is a schematic view showing the dialing mechanism rotating the annular code disc in the clockwise direction in the second embodiment;

FIG. 4B is a schematic view showing the pawl contacting with the ratchet when the dialing mechanism returns in the second embodiment;

FIG. 4C is a schematic view showing the second dialing block ejecting from the sleeve when the dialing mechanism returns in the second embodiment;

FIG. 4D is a schematic view showing the pawl being jacked up when the dialing mechanism returns in the second embodiment;

FIG. 4E is a schematic view showing the dialing mechanism returning in a counterclockwise direction in the second embodiment; and FIG. 4F is a schematic view showing the dialing mechanism returning into the position in a counterclockwise direction in the second embodiment.

FIG. 5A is a front view showing the repositioning mechanism in the second embodiment;

FIG. 5B is a side schematic view of the embodiment seen in FIG. 5A;

FIG. 5C is a side rear perspective view of the embodiment seen in FIG. 5A;

FIG. 5D is a schematic view showing the position of the repositioning mechanism when the dialing mechanism rotates in the clockwise direction in the second embodiment;

FIG. 5E is a schematic view showing the position of the repositioning mechanism when the dialing mechanism rotates in the counterclockwise direction in the second embodiment;

FIG. 5F is a schematic view showing the position of the repositioning mechanism when all the annular code discs are returned to their initial positions in the second embodiment; and FIG. 5G is a schematic view showing the structure of the repositioning mechanism with an additional limiting disc.

Figure 1A:
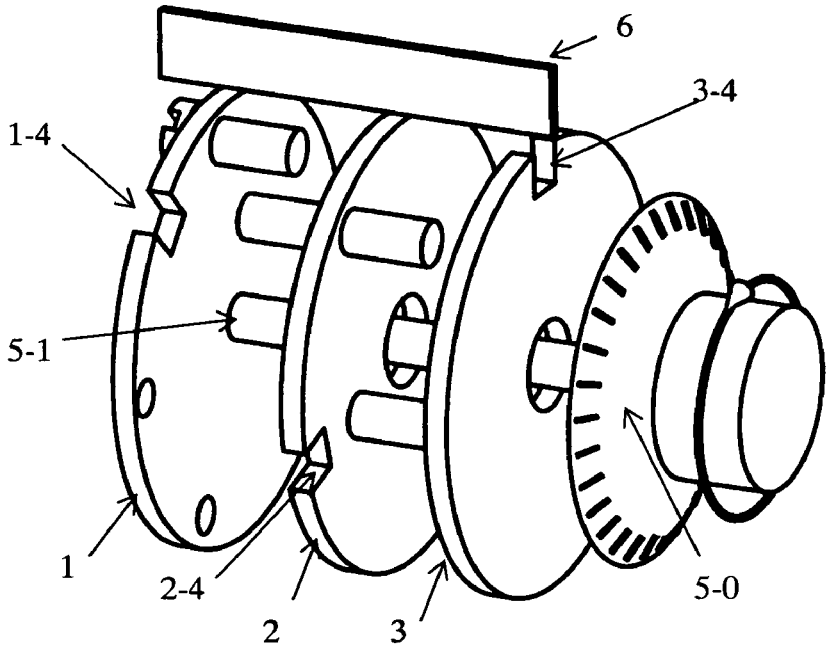
FIG .1A (PRIOR ART)
FIGS. 1A–D are schematic views of the operating process of a conventional disk type mechanical combination lock.
Figure 1C:
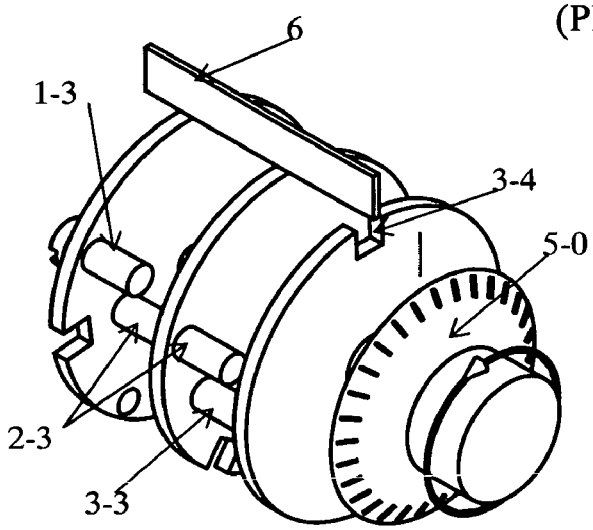
FIG .1C (PRIOR ART)
Figure 1B:
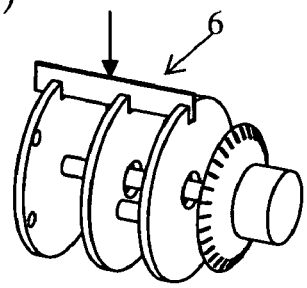
FIG .1B (PRIOR ART)
Figure 1D:
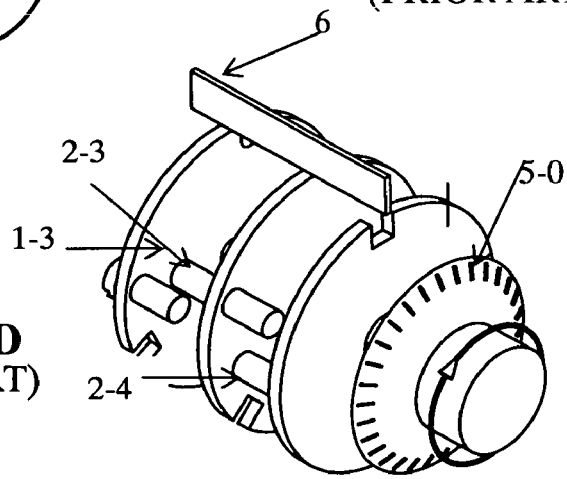
FIG .1D (PRIOR ART)

Next, the method of illustrating the reference numerals will be explained. In the figures, a standalone number denotes a unitary member or an associated assembly and a number followed with a "-" and a number denotes a part of the unitary member or the assembly.

1, 2 and 3—discs (annular code discs); 1-1, 2-1 and 3-1—outer rings of the disc; 1-2, 2-2 and 3-2—inner rings of the disc; 1-3, 2-3 and 3-3—protrusive tongues on the disc; 1-4, 2-4 and 3-4—notches on the disc.

4—repositioning ring of the repositioning mechanism; 4-1—bracket of the repositioning mechanism.

5—frame of the dialing mechanism; 5-0—dial connected to the frame; 5-1—coupling spindle; 5-2—sliding groove on the outer circumference of the frame; 5-3—edge of the controlling disc at an end of the frame; 5-4—repositioning tongue (protrusive tongue) on the cylinder of the frame; 5-5—vertical groove on the frame; 5-6—limit disc; 5-7—notch on the edge of the limit disc.

6—controlling piece of the code-detecting mechanism; 6-0—effective edge of the controlling piece; 6-1—staff of the controlling piece; 6-2—limit boss of the controlling piece. Members 6, 6-0, 6-1, and 6-2 constitute a code detecting mechanism.

7—dialing block; 7-1, 7-2 and 7-3—the respective dialing blocks arranged on different positions; 7-4—arrangement position of the spring of the dialing block; 7-5—rotating shaft of the dialing block; 7-6—limit shaft of the dialing block.

8—sleeve of the controller; 8-1, 8-2 and 8-3—ratchets on the upper half of the edge of the sleeve; 8-1', 8-2' and 8-3'—ratchets on the lower half of the edge of the sleeve corresponding to the ratchets on the upper half; 8-4—fixing means for the sleeve and the frame; 8-5, 8-6 and 8-7—slot openings on the upper half of the circumference of the sleeve; 8-5', 8-6' and 8-7'—slot openings on the lower half of the circumference of the sleeve which are in symmetry to the slot openings on the upper half.

9—pawl of the controlling mechanism; 9-1—front end of the pawl; 9-2—rotating shaft of the pawl.

10—positioning disc of unlatching mechanism; 10-1—notch at the edge of the positioning disc; 10-2—projecting disc of the positioning disc; 10-3—groove on the projecting disc; 10-4—end of the groove. Members 10, 10-1, 10-2, 10-3, and 10-4 constitute an unlatching mechanism.

11—latch pull bar of the latch pulling portion; 11-1—control fork of the latch pulling portion; 11-2—protruding cylinder of the latch pulling portion; 11-3—latch.

DETAILED DESCRIPTION OF THE PREFERRED EMBODIMENT

The First Embodiment

The discs 1, 2 and 3 in FIG. 2 have generally the same function as those in FIGS. 1A–D, in which the latch is released when the notches on the three discs are all in alignment with the controlling piece. However, there are differences in structure. As shown in FIG. 2D, for example, the disc 1 comprises an outer ring 1-1 and an inner ring 1-2 which are generally secured together by a fixing pin (not shown). When the user want to change the code, he may release the fixing pin and let the outer ring and the inner ring rotate relative to each other for an predetermined angle, then the fixing pin is fixed again, thus the code is changed. The protrusive tongue 1-3 is fixed on the inner edge of the inner ring and the notch 1-4 is fixed on the outer edge of the outer ring 1-1. The discs 1, 2 and 3 in FIG. 2D are referred to by their traditional names, they actually are the annular code discs mentioned above.

Figure 2A:
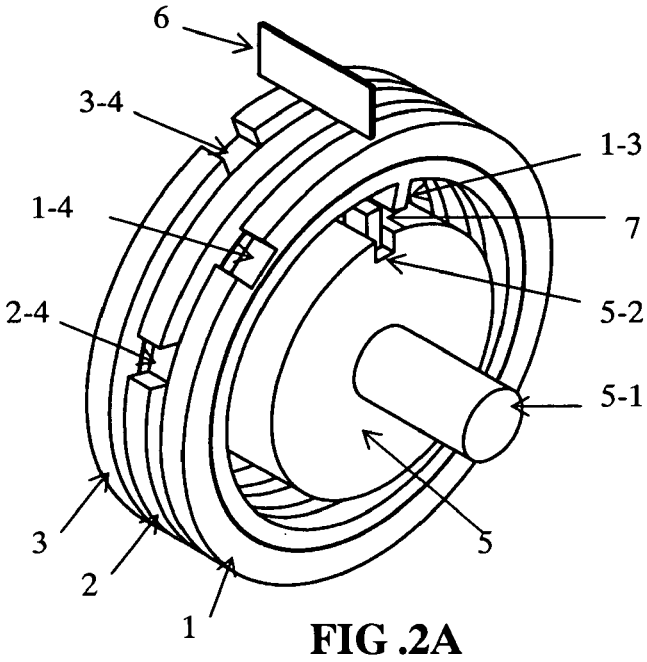
FIGS. 2A–H are schematic views of the structure of the first embodiment of the disk type mechanical combination lock in accordance with the present invention.
Figure 2B:
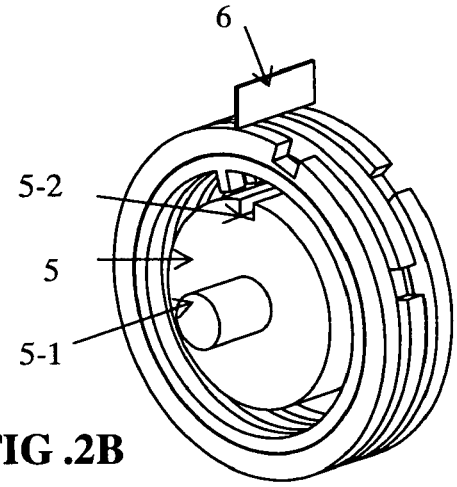
Figure 2C:
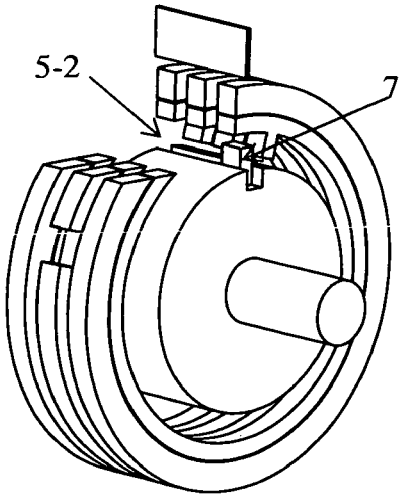
Figure 2D:
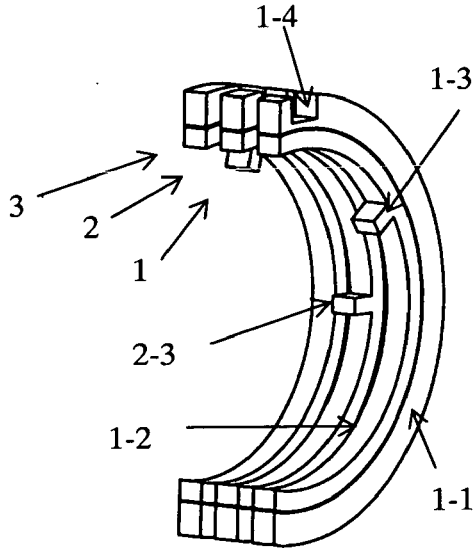

Referring to FIG. 2A, discs 1, 2 and 3 are rotated by a dialing mechanism comprising a frame 5, a dialing block 7 and a cooperated controller. The coupling spindle 5-1 of the frame is coupled to a dial (or referred to as a knob) outside the door to control the outside dial to rotate the frame 5, thus to dial and unlatch. As shown in FIG. 2C, the dialing block 7 may slide longitudinally in the sliding groove 5-2 on the outer circumference of the frame 5.

The process of inputting a combination code includes rotating the three discs into designated positions by the frame 5 through the operation of the dial outside the door, thus aligning the notches of the discs with the control piece 6.

Figure 2E:
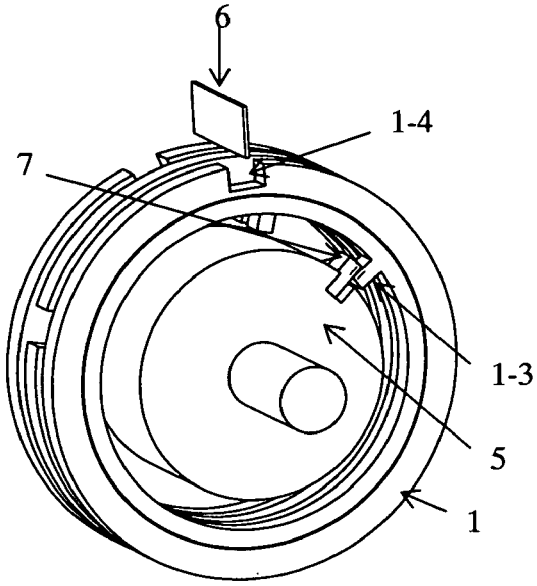

As shown in FIG. 2E, the frame 5 is rotated in the clockwise direction at first, then the disc 1 is rotated correspondingly because the dialing block 7 rotating along with the frame 5 touches the protrusive tongue 1-3 on the disc 1, thus the disc 1 is rotated along with the frame. The rotation of the disc 1 is stopped when the notch 1-4 of the disc 1 is brought into alignment with the control piece 6, the code on the scale plate of the dial which is in alignment with a reference line is determined as the first combination code. The angle (code) to be dialed varies according to the relative angle between the protrusive tongue 1-3 and the notch 1-4. Therefore, the disc in this embodiment is formed of an inner ring and an outer ring which are rotatable relative to each other so that the code can be changed according to the variation of the relative angle between the protrusive tongue 1-3 and the notch 1-4. The degrees of the angle in which the inner ring and the outer ring rotate relative to each other to change one bit of the code depend on the scale on the dial and the width of the notch on the disc. Obviously, the code may be changed by use of other arrangements.

Figure 2F:
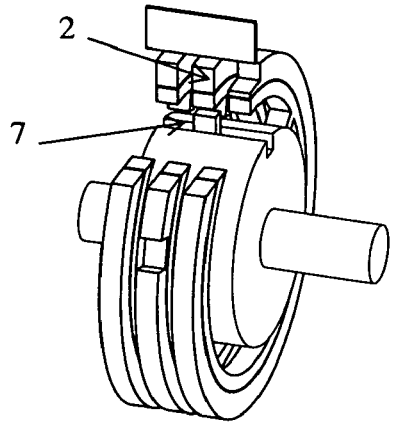

As shown in FIG. 2F, the frame is rotated in the reverse (counterclockwise) direction to return to its initial position after the first code is inputted. A cooperating controller (not shown) moves the dialing block 7 forward into a longitudinal position which is in alignment with the longitudinal position of the disc 2.

Figure 2G:
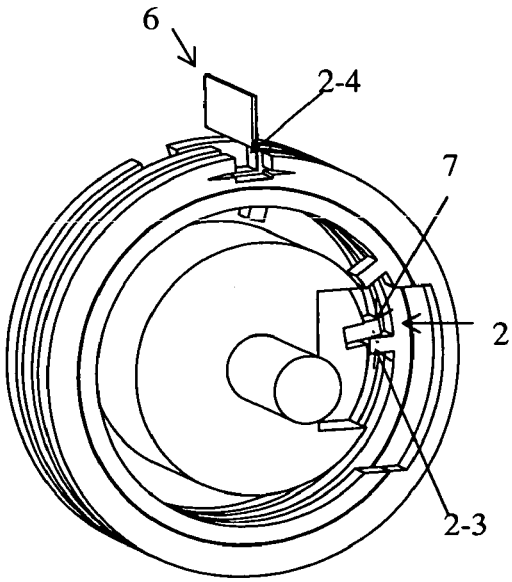

Referring to FIG. 2G, the frame 5 is then rotated in the clockwise direction. The disc 2 is rotated along with the frame because the dialing block 7 rotating along with the frame 5 touches the protrusive tongue 2-3 on the disc 2. The rotation of the disc 2 is stopped when the notch 2-4 of the disc 2 is brought into alignment with the control piece 6, the code on the scale plate of the dial which is in alignment with the reference line is determined as the second combination code. Part of the members in FIG. 2G, are shown in a cutaway view for clarity.

Figure 2H:
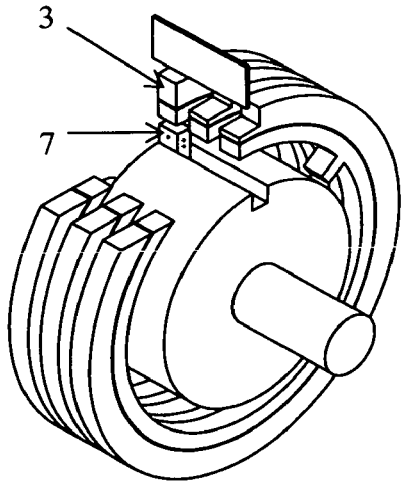

The above operation is repeated to move the dialing block into a position shown in FIG. 2H, then the third combination code is inputted, thus completing the whole code inputting process.

The above process is similar to that in a dial type phone in which a first code is inputted by rotating the dial in a forward direction, then the dial return to its initial position, and the next code is inputted by rotating the dial again in a forward direction.

The Second Embodiment

FIGS. 3A–E show the frame of the dialing mechanism which is coupled to the outer dial and rotates along with the dial. 7 is a dialing block. The sleeve 8, the pawl 9 and the edge of the controlling disc 5-3 constitute the controller.

Figure 3A:
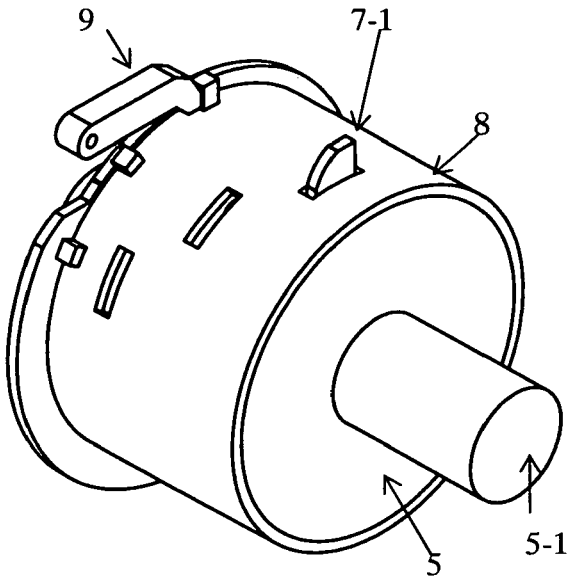
FIGS. 3A–E are schematic views of the structure of the dialing mechanism of the disk type mechanical combination lock according to a second embodiment of the present invention.
Figure 3B:
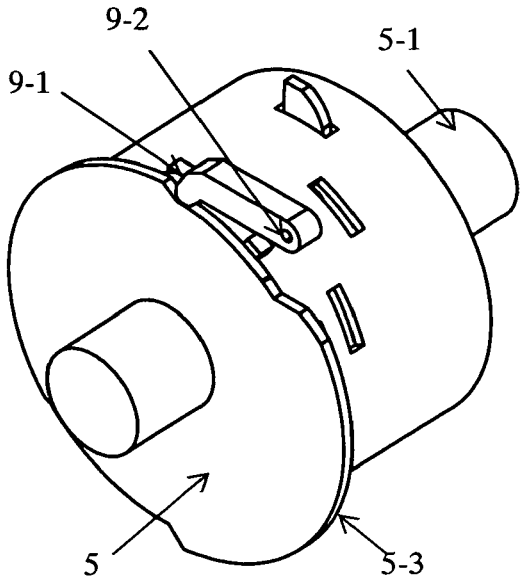
Figure 3C:
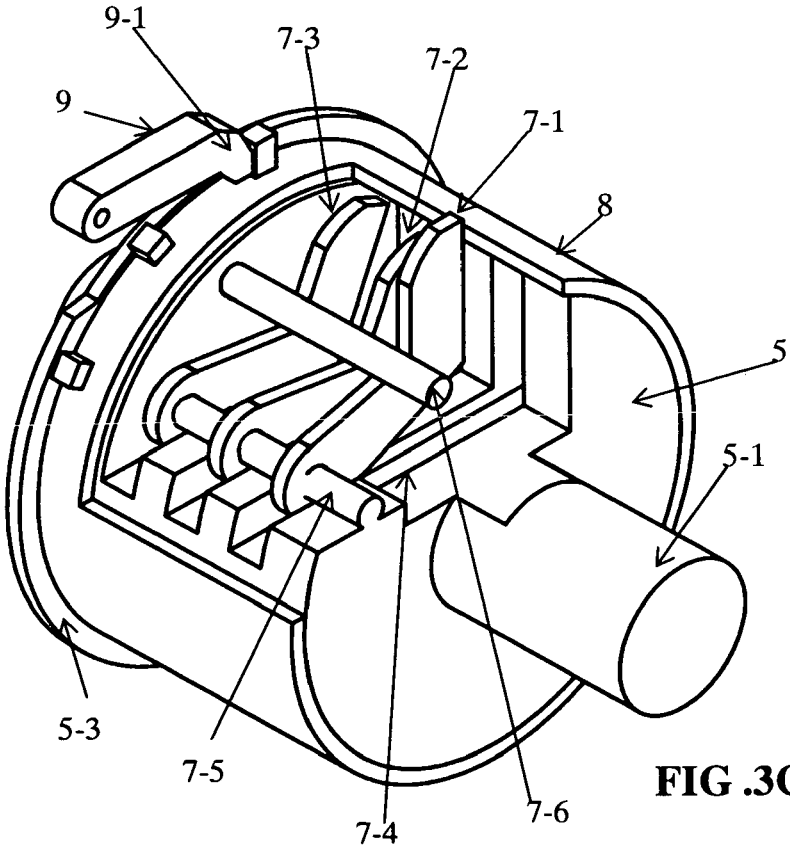
Figure 3D:
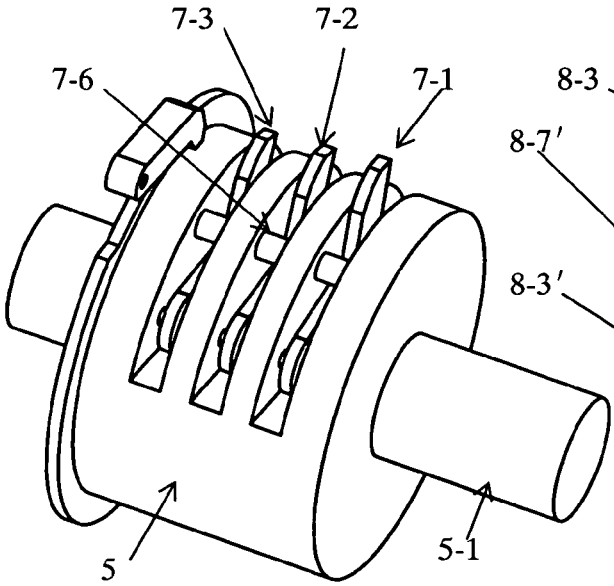

Part of the members in FIG. 3C are shown in a cutaway view for purpose of clarity. As shown in FIG. 3C, dialing blocks 7-1, 7-2 and 7-3 are fitted in sequence over a rotating shaft 7-5 which is disposed on the frame. Due to the effect of spring force, a leading end of a dialing block will eject from the frame as shown in FIG. 3D if it is not restricted by the sleeve 8. The height of the ejecting end of a dialing block is limited because of the blocking effect applied by the limit shaft 7-6. The three dialing blocks are arranged inside respective grooves without axial movement. The dialing block(s) is (are) sheet-shaped.

Figure 3E:
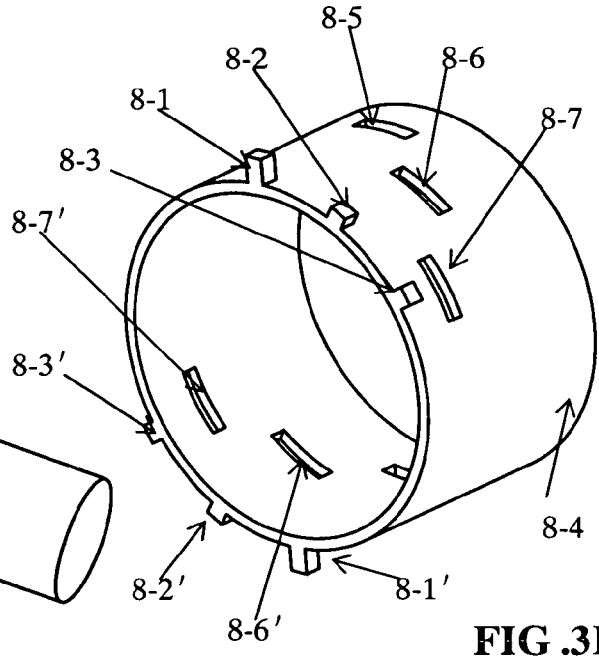

Whether the dialing blocks 7-1, 7-2 and 7-3 (which are preferably sheet-shaped) eject or not depends on the rotation angle of the sleeve 8 relative to the frame 5 when the sleeve 8 is fitted over the frame. As shown in FIG. 3E, slot openings 8-5, 8-6, 8-7 and symmetrical ones 8-5', 8-6', 8-7' are provided on the wall of the sleeve 8 to enable the dialing block eject in sequence. Ratchets 8-1, 8-2 and 8-3 on one side of the sleeve 8 and symmetrical ones 8-1', 8-2' and 8-3' may fit with the pawl 9 to rotate the frame 8 with respect to the frame 5, thus controlling the dialing blocks 7-1, 7-2 and 7-3 to eject or withdraw singly in sequence. This process is equivalent to the step control for the dialing block 7 in FIG. 2. As shown in FIG. 3E, the slot openings and ratchets on the upper half of the circumference of the sleeve 8 are symmetrical to those on the lower half thereof in a diametrical direction. Therefore, the controlling process for the dialing blocks to eject or withdraw singly in sequence is performed when the sleeve rotates for 180 degrees. Only one dialing block ejects and effectively rotates the annular code disc at one time although the dialing blocks eject in sequence, thus the single effective position of the dialing block is changed in sequence.

Referring to FIG. 3B, the rear end of the frame 5 is provided with a projecting edge of the controlling disc 5-3 which is integrally formed with the frame and is rugged in the radial direction. The edge 5-3 is mainly used for controlling the rise and fall of the pawl 9, thus controlling contact between the front end of the pawl 9-1 and the ratchet on the sleeve. The pawl 9 takes the rotating shaft of the pawl 9-2 as its center by the effect of the spring force and the front end of the pawl 9-1 applies force towards the frame.

Referring to FIG. 4, the discs 1, 2 and 3 on the circumference of central controller as shown in FIG. 2 are omitted. These members can be more readily understood with reference to the discs 1, 2 and 3 shown in FIG. 2 or seen from FIG. 5.

Figure 4A:
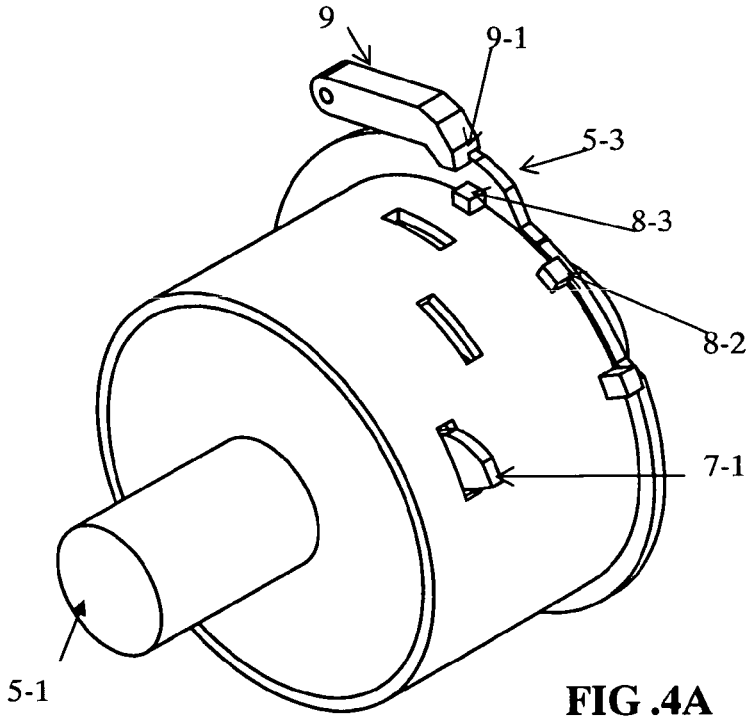
FIGS. 4A–F are schematic views showing the operating process of the dialing mechanism of the disk type mechanical combination lock according to the second embodiment of the present invention.

Referring to FIG. 3A at first, the dialing block 7-1 ejects when the frame 5 is in its initial position, thus having a longitudinal position identical to that of disc 1 as shown in FIG. 2A. Therefore, as shown in FIG. 4A, the dialing block 7-1 functions as the dialing block 7 in FIG. 2E when the frame is rotated in clockwise direction. The disc 1 is rotated into a designated position when the dialing block 7-1 contacts with the protrusive tongue 1-3, thus inputting the first code (also shown in FIG. 5D).

It is noted that the front end of the pawl 9-1 shown in FIG. 4A is pushed up by the edge 5-3. As a result, front end of the pawl 9-1 can not contact with the ratchet so as to ensure that the sleeve steps once each time, thus preparing for the next step.

Figure 4B:
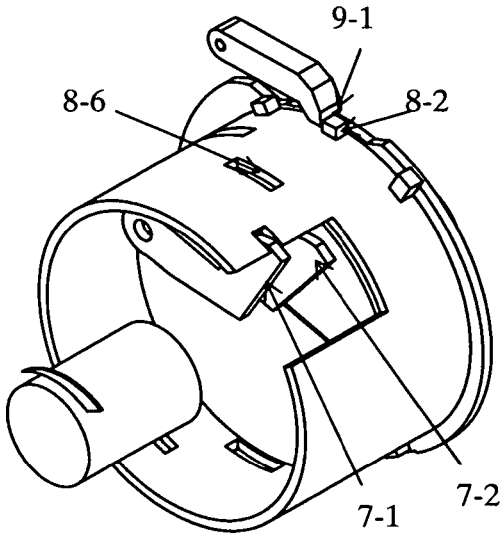
Figure 4C:
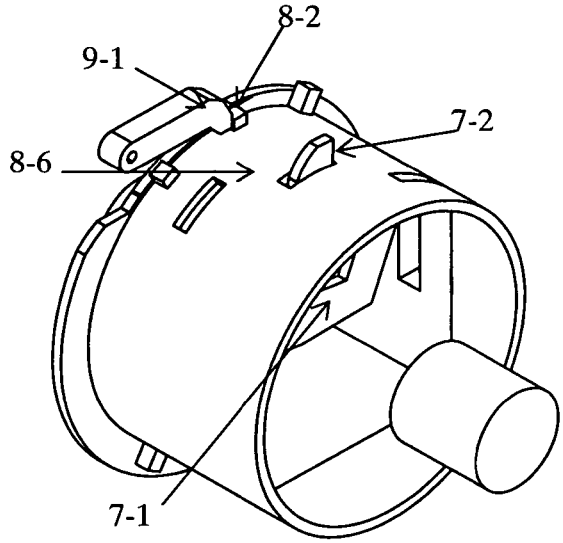

The frame returns to its initial position as shown in FIG. 3A when the first code is inputted. Referring to FIG. 4B, the sleeve 8 can not rotate synchronous with the frame 5 because the front end of pawl 9-1 falls down to restrict the ratchet 8-2 when the frame is close to the initial position. If the frame 5 is further rotated, the dialing block 7-1 is forced to enter into the groove on the frame 5 because the dialing block is rotated along with the frame 5 while the sleeve 8 is kept immovable. As shown in FIG. 4C, when the frame 5 is further rotated to return to its initial position, the front end of the dialing block 7-2 is brought into alignment with the slot opening 8-6 and ejects from the sleeve. This process is equivalent to the dialing block 7 in FIG. 2F rotating one step and aligning with the disc 2. The frame 5 is rotated in forward direction once again and the disc 2 is rotated into a designated position, thus the second code is inputted. The process for inputting the third code is similar to that described above and is omitted here for brevity.

Figure 4D:
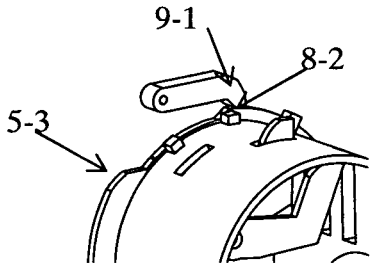

Referring to FIG. 4D, if the dialing block 7-2 has been ejected while the frame is further rotated, and the front end of the paw 9-1 is pushed up by the edge of the controlling disc at an end of the frame 5-3 so as to disengage from the ratchet 8-2. The sleeve 8 does not stay immovable any longer and rotates synchronous with the frame 5, thus the dialing block 7-2 will not fall down. This is the reason why the edge of the controlling disc at an end of the frame 5-3 is formed to be rugged.

Figure 4E:
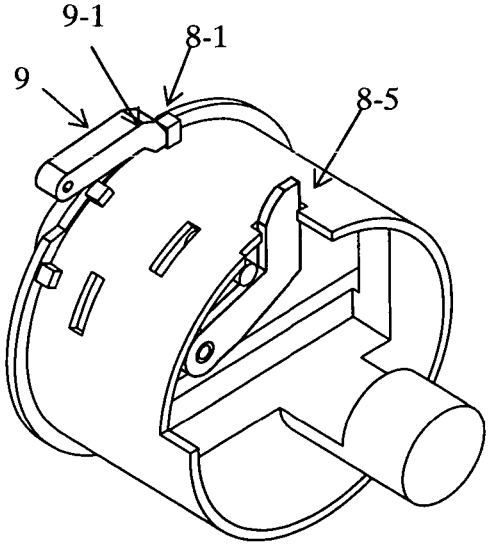

The ratchets 8-1 and 8-1' are also referred as repositioning teeth whose height is evidently higher than the other ratchets. If the frame 5 returns from the initial position as shown in FIG. 4E in the counterclockwise direction, the front end of the pawl 9-1 is also pushed up and released from contacting with the 8-2, 8-3 (8-2', 8-3'), as shown in FIG. 4D. But the front end of the pawl 9-1 is still pushed against the ratchet 8-1 (8-1'). Therefore, so long as the frame 5 returns for 180 degrees from the initial position as shown in FIG. 4E in the counterclockwise direction, a state shown in FIG. 4F will be established irrespective of the degrees of the angle in which the sleeve have rotated. The dialing block 7-1 will be ejected from the slot openings 8-5 of the sleeve 8 because the sleeve is symmetrical in the upward and downward direction. The next turn of code inputting may be started if the frame is returned to the initial position as shown in FIG. 4E in the clockwise direction. The operation of the frame to return for 180 degrees relative to the sleeve (from the initial position) is referred as repositioning.

Figure 4F:
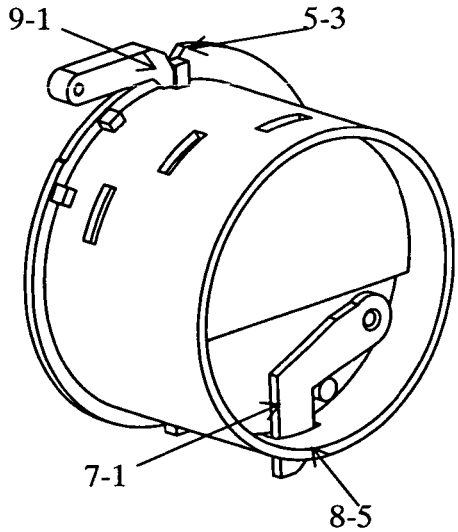

Referring to FIG. 4F, the edge of the controlling disc at an end of the frame has a height higher than that shown in FIG. 4D; if the counterclockwise rotation is continued, the front end of the pawl 9-1 is pushed up to disengage from contacting with the ratchet 8-1 (8-1'). Therefore, it is ensured that an excessive repositioning will not occur. This will also facilitate the cooperation between the frame and other mechanisms during the repositioning process. The controller in the dialing mechanism is composed of sleeve 8, pawl 9 and the edge of the controlling disc at an end of the frame 5-3. Accordingly, the operating process of the disk type combination lock of the present invention can be sequentially executed.

Figure 5A:
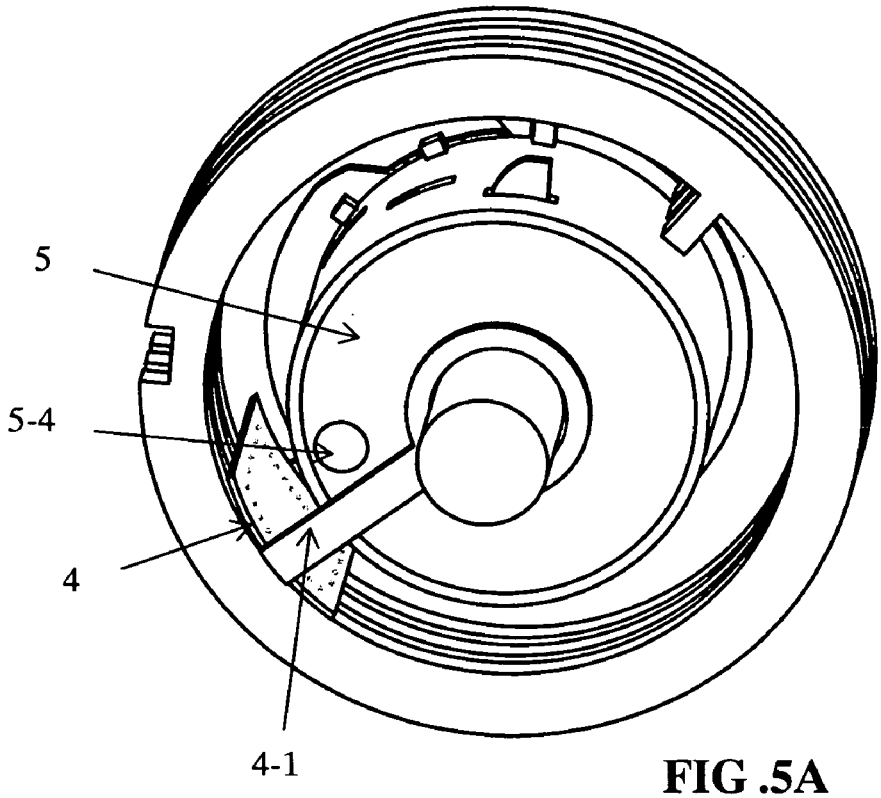
FIGS. 5A–G are schematic views showing the structure of the repositioning mechanism of the disk type mechanical combination lock according to the second embodiment of the present invention.
Figure 5B:
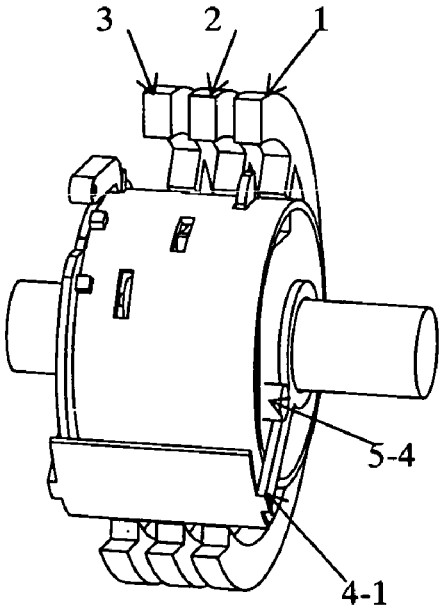
Figure 5C:
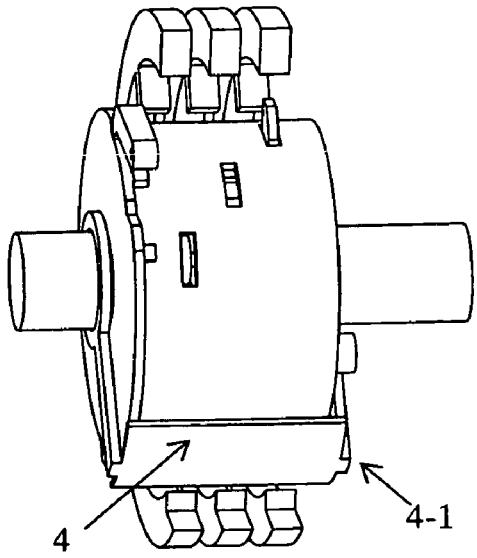
Figure 5D:
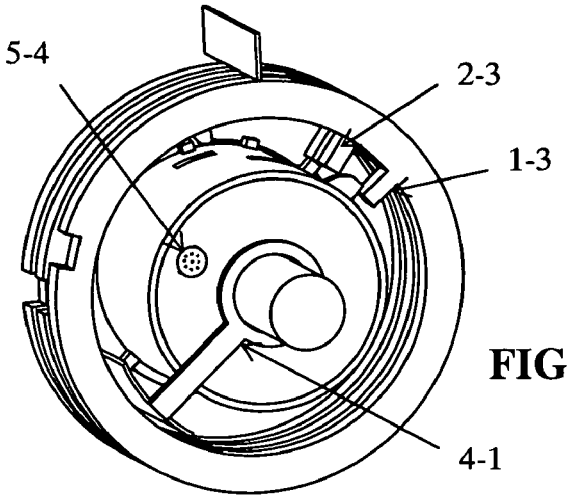
Figure 5G:
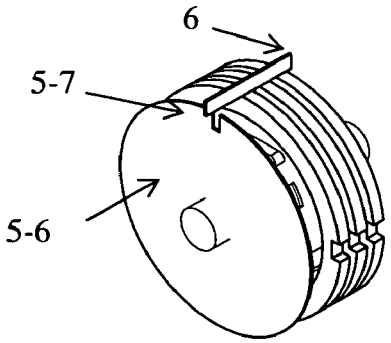
Figure 5E:
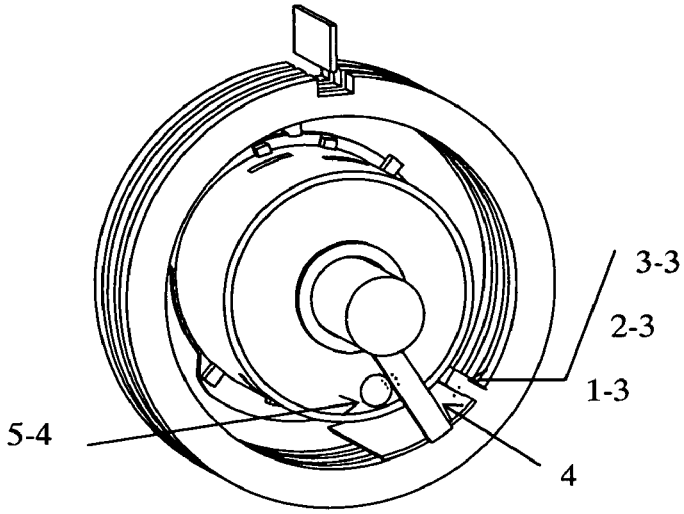
Figure 5F:
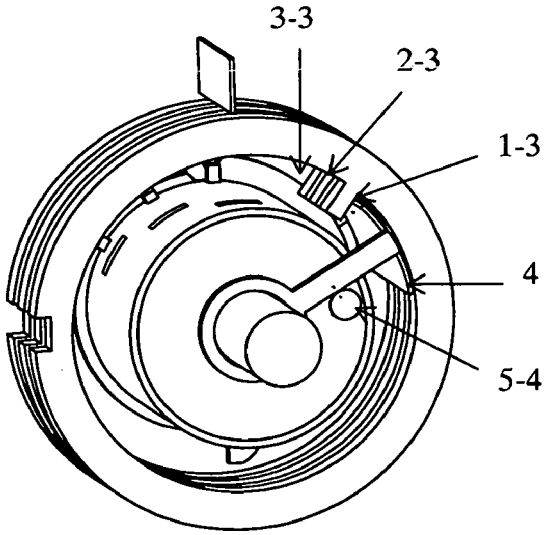

As shown in FIGS. 5A, 5B and 5C, the front side of the cylinder of the frame 5 is added with a repositioning tongue (protruding tongue) 5-4 which can rotate the bracket 4-1 of the repositioning ring (or brush) 4. Referring to FIG. 5D, the repositioning tongue 5-4 separates from the bracket 4-1 so as not to drive the repositioning ring 4 to rotate when the frame is rotated in the clockwise direction to input a code. As shown in FIG. 5E, the repositioning ring 4 is rotated along with the frame 5 in the counterclockwise direction due to contact between the repositioning tongue 5-4 and the bracket 4-1 when the frame rotates from the initial position in the counterclockwise direction. The discs 1, 2 and 3 also return in the counterclockwise direction into the initial position as shown in FIG. 5F because one side of the repositioning ring 4 rotates the protrusive tongues 1-3, 2-3 and 3-3, thus getting ready for the next turn of code inputting. During the course of repositioning, an unlatching process is also performed at the same time by a code detecting mechanism, comprising members 6, 6-0, 6-1, and 6-2, and an unlatching mechanism, comprising members 10, 10-1, 10-2, 10-3, and 10-4, through the operation of the dial. If separate dials are used for code inputting and unlatching, a linkage mechanism is required to be provided therebetween. As shown in FIG. 5G, a limit disc 5-6 with a notch is provided at the rear end of the frame 5. Only if the notch 5-7 of the limit disc is in alignment with the controlling piece 6 when the frame 5 is in its initial position, is the controlling piece allowed to move downward. The controlling piece can not move downward when the frame is rotated in the forward direction, thus preventing willful code detecting in an unauthorized way.

Figure 8:
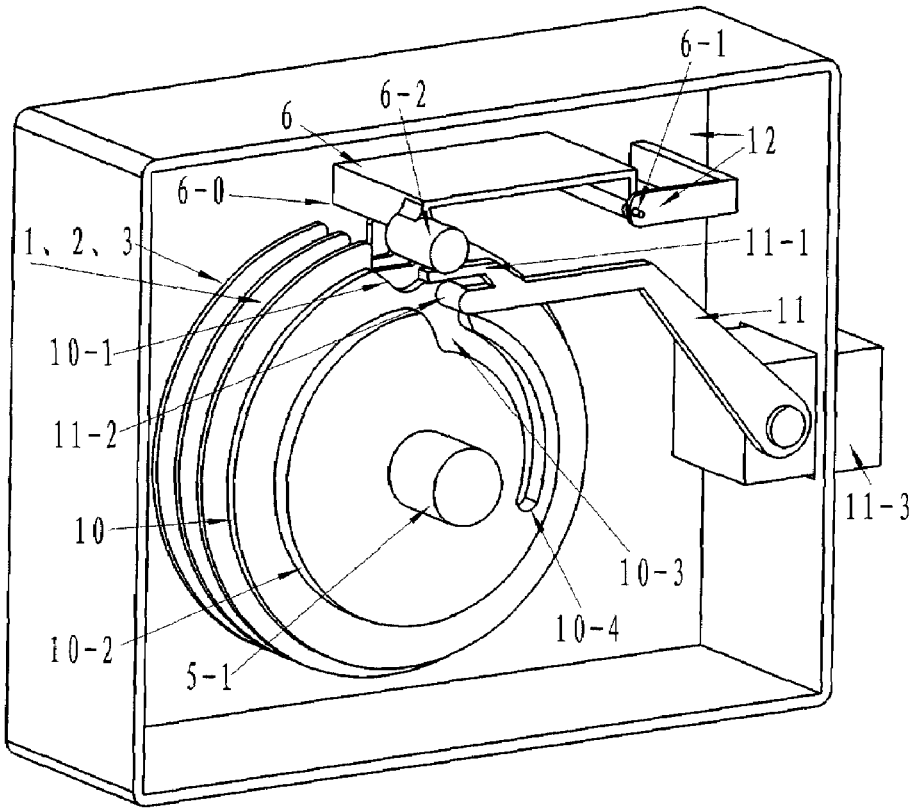
FIG. 8 is a schematic view of a code-detecting mechanism.

As shown in FIG. 8, the reference number 6-0 designates the front end of the controlling piece of the code detecting mechanism. When the dial is rotated in the counterclockwise direction, the positioning disc is synchronously rotated for an angle shown in FIG. 8 in which the notch

10-1 at the edge of the positioning disc is in alignment with the limit boss 6-2 of the controlling piece 6, thus allowing the controlling piece 6 of the code detecting mechanism to rotate reversely and to move down around the staff 6-1 fixed on a base disc 12. If all the discs are rotated to their designated positions and the notches are in alignment with the edge 6-0, the controlling piece 6 moves downward. At the same time, the limit boss 6-2 presses down the control fork 11-1. As a result, the latch pull bar is moved down and the protruding cylinder

11-2 at its left end is inserted into the groove 10-3 in the projecting disc 10-2 of the positioning disc 10. The protruding cylinder 11-2 is retained in the groove when the dial is further reversely rotated. When the dial is further reversely rotated, the end 10-4 of the groove will rotate the protruding cylinder 11-2 to move leftwards, thus the latch pull bar 11 is moved leftward to unlatch the latch 11-3. The controlling piece 6 can not move downward if any one of the annular code discs is not rotated to the designated position, thus the latch pull bar 11 remains at its original position without unlatching the latch. The cooperation between the notch 10-1 and the limit boss 6-2 ensures that the controlling piece 6 move downward into the annular code disc only when the dial is in a predetermined rotation angle and the other angles will not influence the rotation of the annular code disc. Members 8, 10, and 10-1 also constitute a positioning mechanism.

A novel operation manner is realized through the above mechanism. The operation is summarized as follows: The dial is rotated in a forward direction for a predetermined angle to input a code, then the dial is returned to its initial position for the inputting of the next code; The dial is rotated again in a forward direction to input the next code; the procedure is repeated so that all the codes are inputted; The dial is rotated in a reverse direction to enable all the mechanism be repositioned so as to be ready for the next turn of operation; The lock will be unlatched at the time of reverse rotating if the combination code is correct; If an error occurs in the code inputting process, the dial is rotated in the reverse direction to restart an inputting operation.

Figure 6:
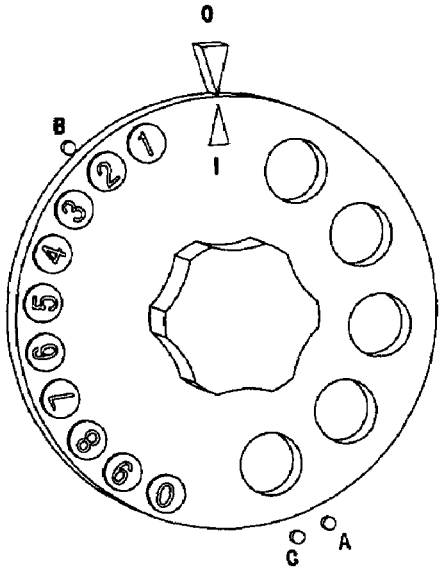
FIG. 6 is a schematic view of a dial in which the scale is formed on a movable disc.

In this embodiment, three discs (3-bit code) are used only for illustrating the general principle of the invention rather than limiting the scope of the invention. In practice, six discs (6-bit code) are usually adopted taking both the code amount of no less than 1 million and convenience of operation into account. If ten numerals (0~9) are formed at the edge of the dial, as shown in FIG. 6, then $10^6$ (1 million) sets of code are obtained in case of using 6-bit code, ranging from 000000~999999. If the characters of "#" and "*" are introduced into the above mentioned ten numerals, $12^6$ (298.5 million) sets of codes. More than 1 million sets of codes will also be obtained when 5-bit code and hexadecimal system are applied.

Third Embodiment

Figure 9:
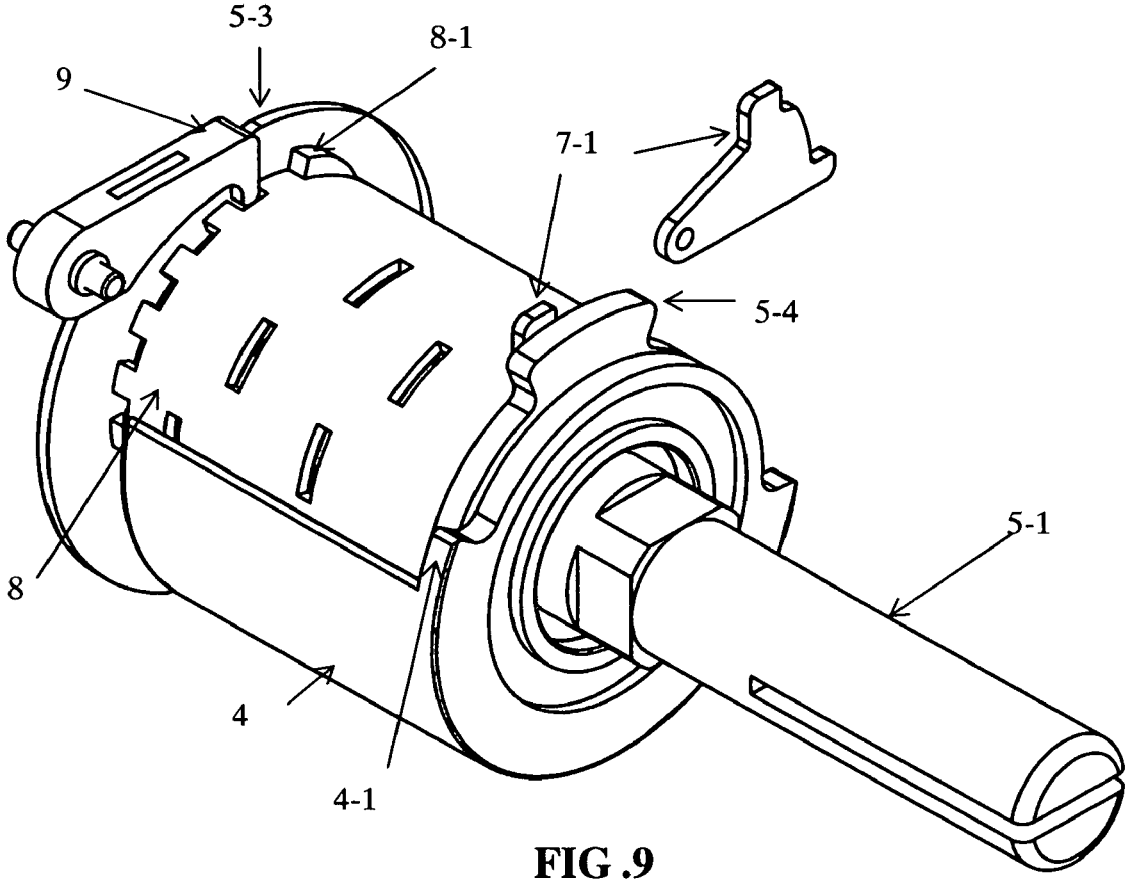
FIG. 9 is a schematic view of a dialing mechanism in accordance with the third embodiment of the present invention.

FIG. 9 shows a 6-bit disk type mechanical combination lock in which only the dialing mechanism and the repositioning mechanism are revealed. Unlike the example described above, this embodiment employs six dialing blocks in which the dialing block 7-1 ejects from the sleeve 8 and the other dialing blocks are arranged inside the sleeve 8 which are not invisible. This dialing mechanism may rotate six annular code discs. The shape of the edge 5-3 of the controlling disc, repositioning tongue 5-4, pawl 9, sleeve 8, ratchet 8-1 on the sleeve (including the other ratchets and slot openings), repositioning ring 4, bracket 4-1, coupling spindle 5-1 and dialing block 7-1 is accordingly modified from the second embodiment in consideration of the machining process and the installation structure. But the principal and operation of this embodiment is similar to those of the second embodiment.

Fourth Embodiment

Figure 10:
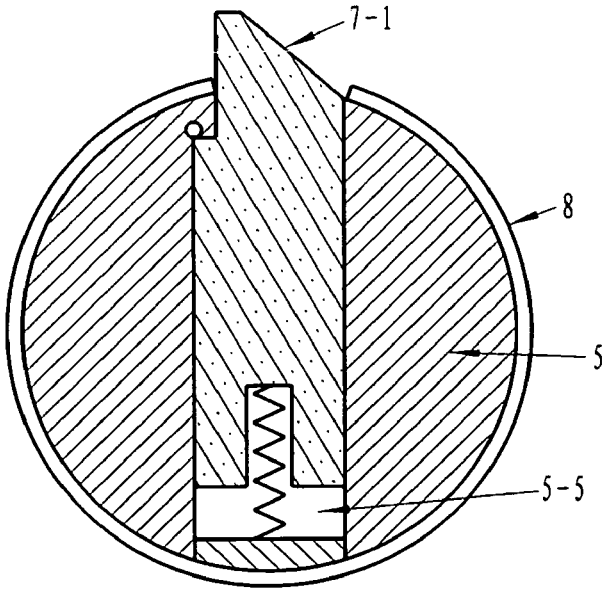
FIG. 10 is a partial sectional view of a dialing mechanism in accordance with the fourth embodiment of the present invention.

As shown in FIG. 10, the fourth embodiment differs from the second and third embodiments in that the dialing block 7-1 (including the other dialing blocks) is arranged in the vertical groove 5-5 of the frame 5 and may slide up and down along the vertical groove 5-5. Being restricted by the sleeve 8 of the controller, ends of several blocks eject from the sleeve in sequence and the remaining other ones are pushed back into the sleeve 8. This structure is adapted for certain machining processes.

FIG. 6 is a schematic view showing the structure of a dial according to the invention in which ten numerals (0~9) are formed at the edge of the dial. The dial is rotated in a clockwise direction to align a predetermined numeral on the dial with the reference line O. Then the dial is returned to its initial position as shown in this figure. The dial is rotated in the clockwise direction so as to input the next code. The largest angle during the forward rotation makes reference point line I rotates in the clockwise direction from O to A. The inner code detecting mechanism contacts with the unlatching mechanism, so that the unlatching mechanism gets ready for unlatching, if the controlling piece of the inner code-detecting mechanism is in alignment with the notch of the disc when the reference point line I rotates in the counterclockwise direction from O to B; otherwise the unlatching operation is cancelled. The reference point line I further rotates in the counterclockwise direction from B to C, then the repositioning process is performed inside the mechanism. If a correct combination code is inputted, it is also required to pull the latch. The dial is rotated in the counterclockwise direction and then returned to the initial position shown in this figure, and it is required to input the code again for releasing the latch.

Figure 7:
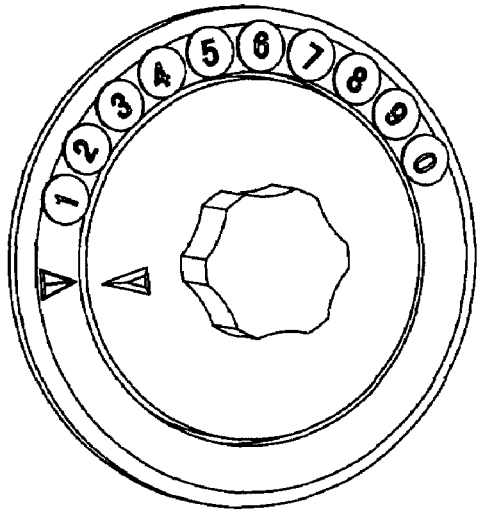
FIG. 7 is a schematic view of a dial in which the scale is formed on an immovable disc.

FIG. 7 is a schematic view showing the structure of a dial in which the numerals are formed on a fixed disc at the outer circumference of the dial and only the reference line are formed on the dial. The function of rotation is the same as that shown in FIG. 1 and the description is omitted. The advantage of this structure is that the scale is distinctly visible and is not liable to be worn out during use.

INDUSTRIAL APPLICABILITY

The present invention may be applied in safes, file cabinets, security doors, vaults and warehouse doors and civil doors. It may replace the conventional disk type mechanical combination lock and part of the electronic combination lock.

The invention claimed is:

1. A disk type mechanical combination lock comprising a plurality of annular code discs, a base disc, a latch, an unlatching mechanism, a positioning mechanism, a casing and an outer dial, characterized in that it further comprises:

a dialing mechanism comprising:

a frame comprising a cylinder in which a groove is defined for accommodating a dialing block and a protrusive tongue at an end of said cylinder, said frame being connected by a coupling spindle to said outer dial;

said dialing block being sheet-shaped and disposed in said groove of said frame, an end of said dialing block being movable in and out of a sleeve; and a controller comprising:

said sleeve, a pawl, and a controlling disc, said sleeve being rotatably fitted over said cylinder of said frame and having at least one circumferential slot on a surface thereof in which said end of said dialing block is movable, and at least one ratchet disposed on an end surface of said sleeve, said controlling disc having at one end of said frame a projecting edge at an outer edge of said controlling disc, said pawl being fixed on said base disc by a rotating shaft, a front end of said pawl being in contact with said outer edge of said controlling disc and with said at least one ratchet on an end surface of said sleeve, a repositioning mechanism comprising a repositioning ring and a bracket, said repositioning ring comprising a generally annular sheet rotatable about said spindle by said bracket, and a code-detecting mechanism comprising a controlling piece, a limit boss, and a staff, said controlling piece being fixed on said base disc through said staff with a front end of said controlling piece being in contact with said outer edge of said annular code discs.

2. The disk type mechanical combination lock according to claim 1, wherein each of said annular code discs comprises an inner ring and an outer ring, said rings rotatable relative to each other, and said inner ring and said outer ring secured together by a releasable fixing mechanism.

3. The disk type mechanical combination lock according to claim 1 further comprising a second set of at least one circumferential slot and at least one ratchet diametrically symmetrical to, and disposed on a half of a circumference of said surface opposite of, said at least one circumferential slot and said at least one ratchet, respectively.

4. The disk type mechanical combination lock according to claim 1, further comprising a repositioning tongue on a front side of said frame, said repositioning tongue contactable with said bracket of said repositioning ring to rotate said bracket.

5. The disk type mechanical combination lock according to claim 1, further comprising a limit disc with a notch defined therein disposed at a rear end of said frame for preventing unauthorized willful code detection.

* * * * *